United States Patent [19]

Mantingh

[11] Patent Number: 4,928,409

[45] Date of Patent: May 29, 1990

[54] MOBILE EARTH MOVER BOWL WITH LOADING ROTOR

[76] Inventor: Jan Mantingh, Broek 8, 9511 PT Gieterveen, Netherlands

[21] Appl. No.: 248,984

[22] Filed: Sep. 23, 1988

[30] Foreign Application Priority Data

Sep. 25, 1987 [NL] Netherlands ..... 8702301

[51] Int. Cl.[5] ..... B60P 1/00; E02F 1/00

[52] U.S. Cl. ..... 37/9; 37/124; 37/129

[58] Field of Search ..... 37/129, 133, 128, 126 R, 37/126 A, 126 AC, 126 AD, 126 AE, 124 R, 4, 9

[56] References Cited

U.S. PATENT DOCUMENTS

| | | | |
|---|---|---|---|
| 2,224,869 | 12/1940 | Jensen | 37/259 |
| 2,284,412 | 5/1942 | Frentzel, Jr. et al. | 37/126 A |
| 2,564,563 | 8/1951 | Clark . | |
| 2,634,962 | 4/1953 | Eglitis | 37/259 |
| 2,944,350 | 7/1960 | Bartsch . | |
| 3,090,139 | 5/1963 | Hancock | 37/129 |
| 3,315,381 | 4/1967 | Fisher | 37/233 |
| 3,474,547 | 10/1969 | Campbell et al. | 37/126 R |
| 3,479,755 | 11/1969 | Schropp | 37/129 |
| 3,484,843 | 12/1969 | Martin | 37/126 R |
| 3,486,251 | 12/1969 | Carston | 37/129 |
| 3,533,174 | 10/1970 | Carston . | |
| 3,574,960 | 4/1971 | Peterson . | |
| 3,706,143 | 12/1972 | Knell et al. | 37/126 R |

FOREIGN PATENT DOCUMENTS

| | | | |
|---|---|---|---|
| 964617 | 3/1975 | Canada | 37/126 AC |
| 0996648 | 2/1983 | U.S.S.R. | 37/124 |
| 616649 | 12/1945 | United Kingdom . | |
| 1144699 | 8/1967 | United Kingdom . | |

*Primary Examiner*—Eugene H. Eickholt

*Attorney, Agent, or Firm*—Amster, Rothstein & Ebenstein

[57] ABSTRACT

An earth mover comprising at least one wheeled axle; a supported frame movable by the axle, said frame further including means for pushing up soil, comprising an elongate scraper blade with a ground-facing sharp longitudinal edge being substantially right-angled to the forward direction of travel of the apparatus. The apparatus is characterized by a cylindrical rotor provided at an interspace from, and in operative position above, the scraper blade, and substantially parallel thereto. It is also characterized by means for rotating the rotor in a direction from the longitudinal edge towards the upper portion of the scraper blade; and by bars mounted on the rotor. The distance from the turning circle circumference of the bars to the scraper blade decreases in the rotation direction of the rotor.

10 Claims, 6 Drawing Sheets

MOBILE EARTH MOVER BOWL WITH LOADING ROTOR

This invention relates to an earth mover comprising at least one wheeled axle;

a supported frame movable by the axle, said fraime further including means for pushing up earth, comprising an elongate scraper blade having an earthfacing sharp longitudinal edge substantially right-angled to the forward direction of travel.

A known earth mover of this type is the so-called scraper. Characteristic for earth movers of this type is that the means for pushing up earth, such as the scraper blade, become operative when the apparatus is moved. During the travel of the earth mover, e.g. by drawing it behind a tractor, or by means of its own drive system, the scraper blade scrapes off a layer of soil in a layer thickness that depends upon the depth of insertion of the scraper blade. The layer is then pushed up against the scraper blade and deposited in a bowl located behind the scraper blade, as viewed in the forward direction of travel of the apparatus, said scraper blade being pivotally connected to the bowl. When the bowl is sufficiently filled, it can be closed and subsequently moved to a selected place, where the earth can be discharged from the bowl.

A problem in the known above described earth movers is that the soil accumulates directly behind the scraper blade in the bowl, so that an efficient loading of the bowl is prevented, and the effective loading capacity is small.

It is an object of the present invention to eliminate the above drawback and to provide in general an efficient earth mover of the above described type having a large effective loading capacity.

To that end, according to the present invention, an earth mover of the above described type is characterized by a cylindrical rotor disposed at an interspace from and, in operative position, above the scraper blade, substantially parallel thereto; means for rotating the rotor in a direction from the longitudinal edge to the upper part of the scraper blade; and bars mounted on the rotor, with the distance from the turning circle circumference of the bars to the scraper blade decreasing in rotation direction.

An earth mover according to the present invention is not only usable for earth, but more in general for granular materials having the structure of earth. For instance, the earth mover is also usable for sand, which material is used and processed on a large scale e.g. in road construction.

One embodiment of an earth mover according to the present invention will now be described, by way of example, with reference to the accompanying drawings, in which.

Figure 5A:
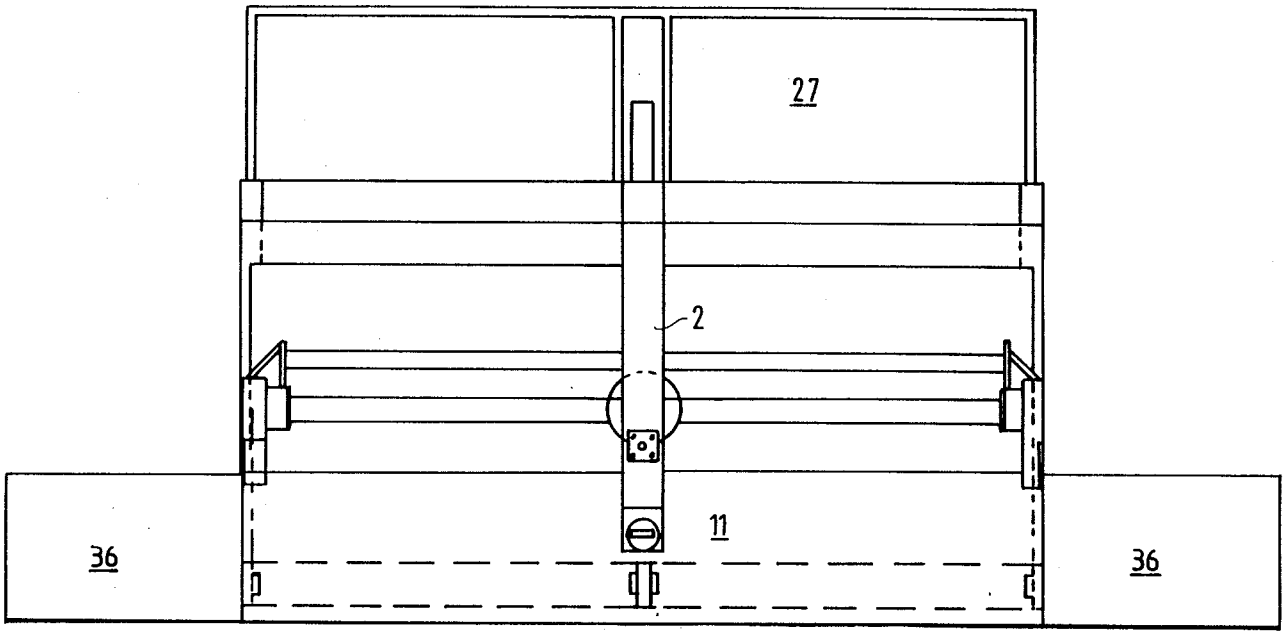
Figure 5B:
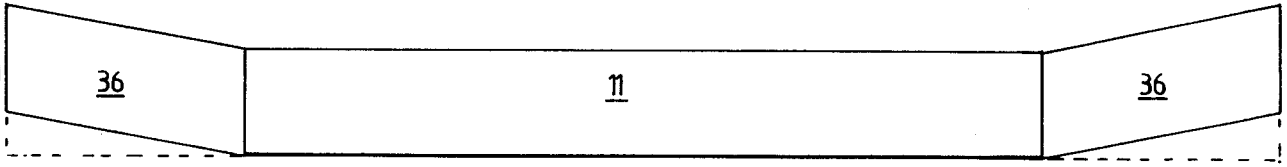
Figure 6:
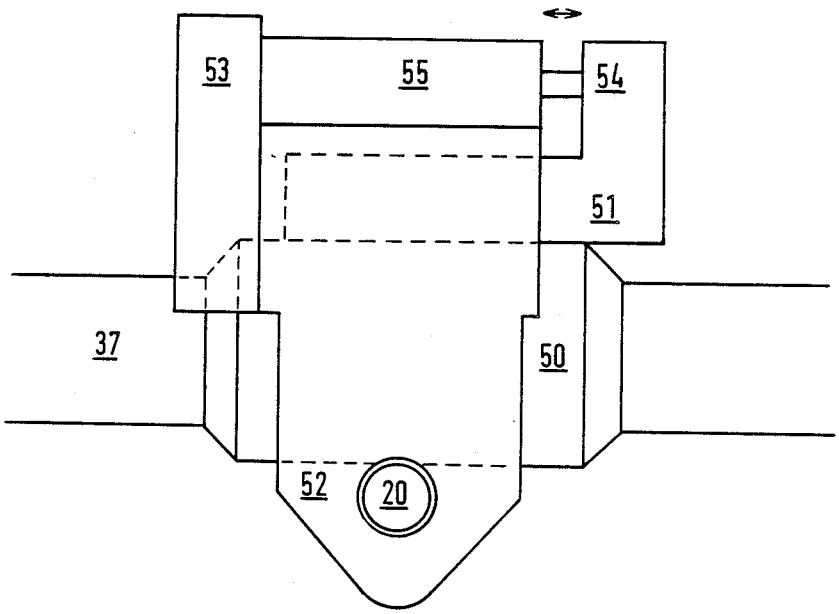

FIG. 5*a* is a diagrammatic front view of an earth mover according to the present invention, wherein the working width of the scraper blade is extended by attachment of scraper blade portions on either side of the scraper blade;

FIG. 5*b* is a front view of exclusively the scraper blade shown in FIG. 5*a* in loading position; and FIG. 6 is a detail view of an apparatus according to the present invention.

Figure 1:
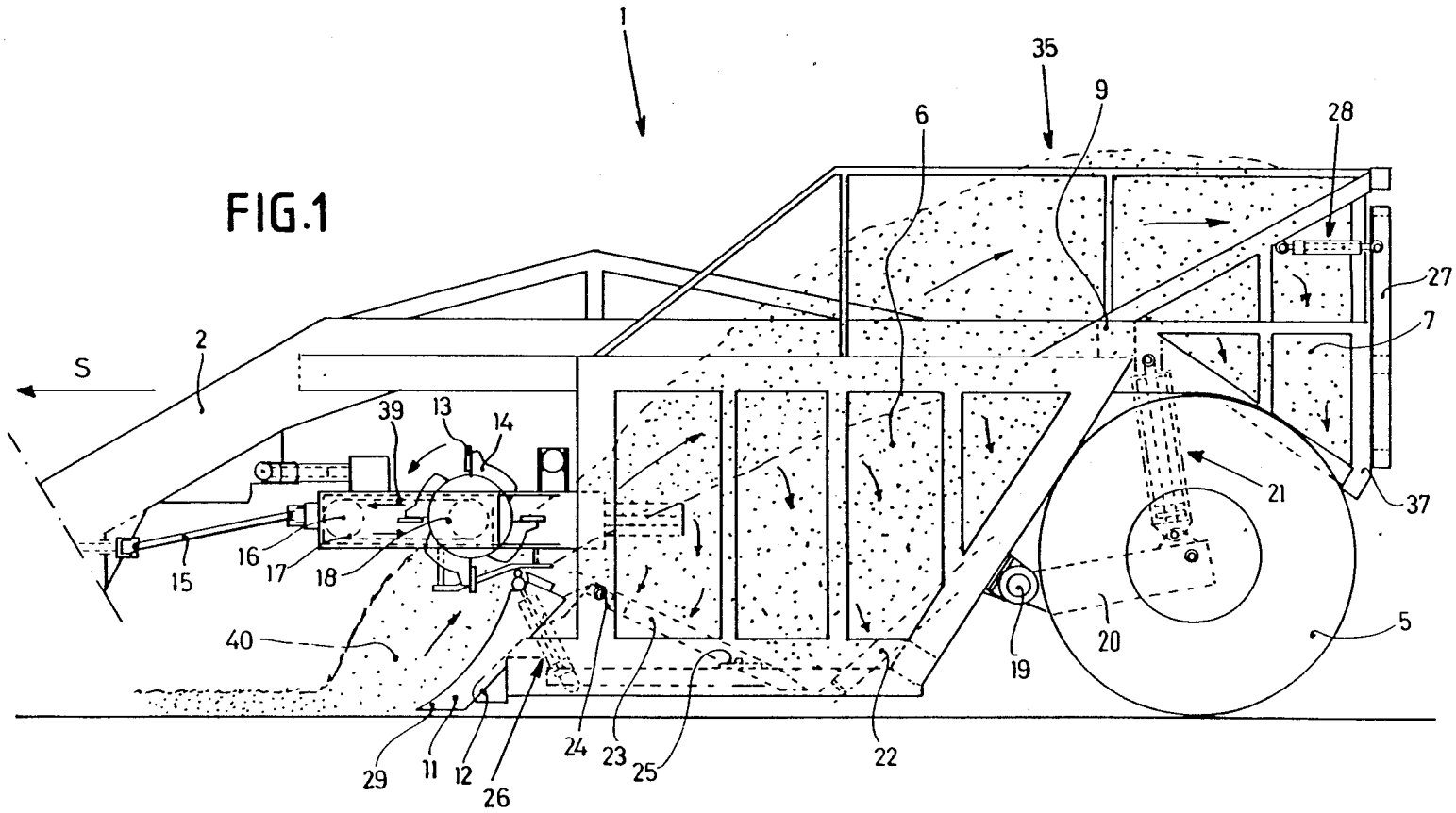
FIG. 1 is a side view of an earth mover according to the present invention in a position usable for the loosening of, and loading with, earth.

FIG. 1 shows at 1 an earth mover having a frame including a supporting beam 2, serving at the same time as a drawbar, by means of which the earth mover can be attached through coupling means, not shown, to the rear of a tractor, not shown, and whose forward direction of travel is indicated by arrow S.

The mobile earth mover shown in the drawing is of the single-axle type and rests with wheels on the ground.

FIG. 1 shows at 35 a bowl for temporary storage of earth, divided in this example into a front bowl portion 6 and a rear bowl portion 7 communicating with one another. Front portion 6 and rear portion 7 are separated by a threshold zone 9.

FIG. 1 further shows a rotor 10 and a scraper blade 11 with scraper edge 29, said blade 11 being pivotally connected to the underside of the frame in blade pivot point 12. Rotor 10, in this example, is a cylinder arranged horizontally above, and slightly in front of, the scraper blade, with bars 13 being provided on the curved side wall of said cylinder via holding devices 14. The bars extend parallel to the rotor axis.

Figure 2:
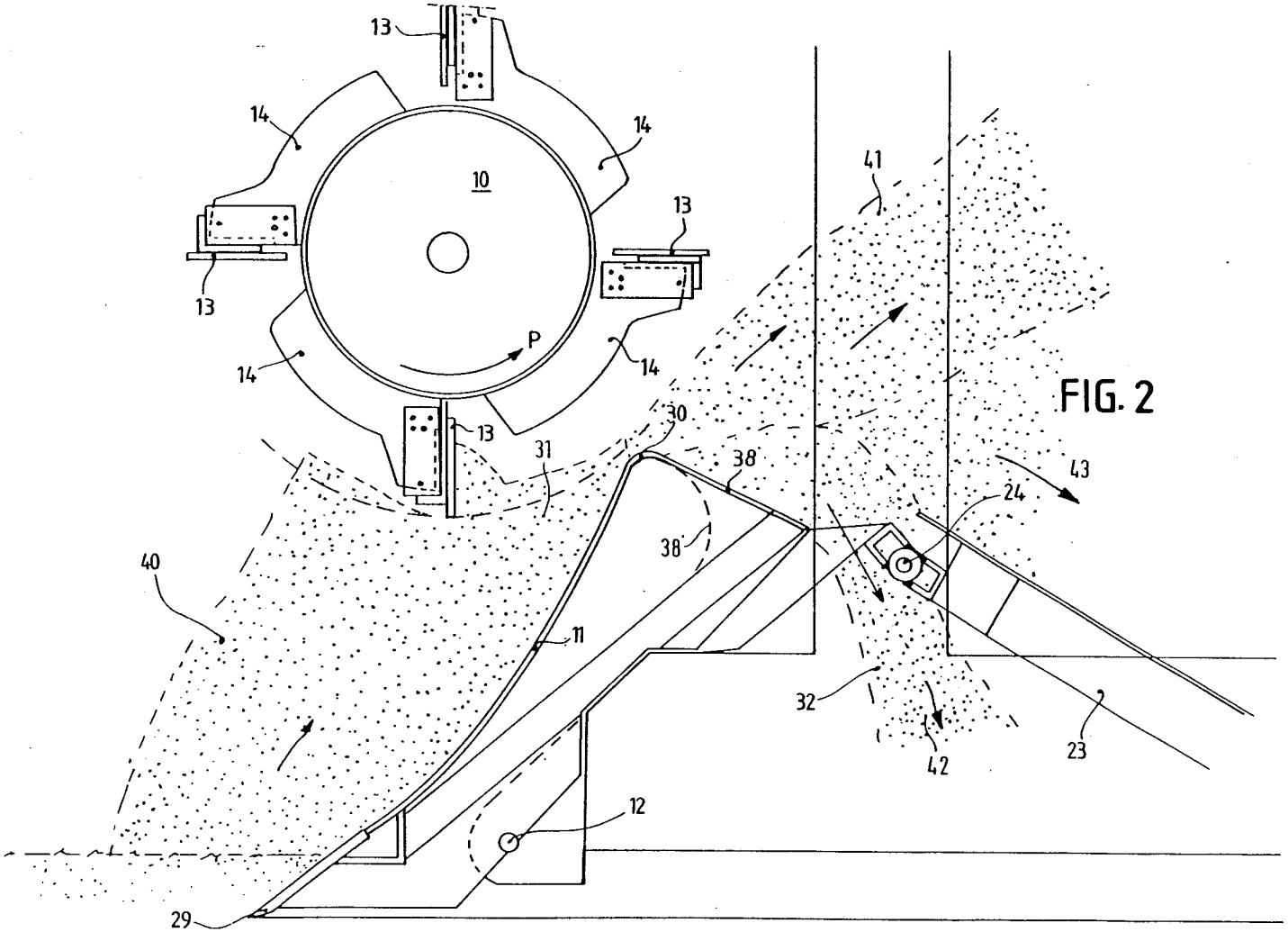
FIG. 2 is a diagrammatic side view of a part of an apparatus according to the present invention in a first position, in which the scraping off of the soil has just commenced.

For driving and operating the earth mover, use is made of the power take-off shaft and the hydraulic device of a tractor, not shown. At 15 is shown a cardan shaft through which, in operation, a drive shaft 16 is driven. Drive shaft 16 drives the rotor 10 via a gear-chain transmission, comprising gears 17,18, connected to the drive shaft 16, and to the rotor 10, respectively, at their ends, and chains 39. The rotation direction of the rotor is indicated by arrow P (FIGS. 2 and 3).

The axle of wheels 5 is pivotally connected at 19 through an arm 20 to the frame. Furthermore, the frame is supported on the wheel axle via at least one hydraulic cylinder 21.

The front bowl portion 6 has a dividable bottom having in this example rear bottom wall 22 and a bottom flap 23 slidable therefrom, constituting at the same time the front bottom wall. Bottom flap 23 in this example is connected on the one hand in pivot point 24 pivotally to the scraper blade 11, and on the other hand through sliding members 25 slidingly to a lower frame portion.

Figure 3:
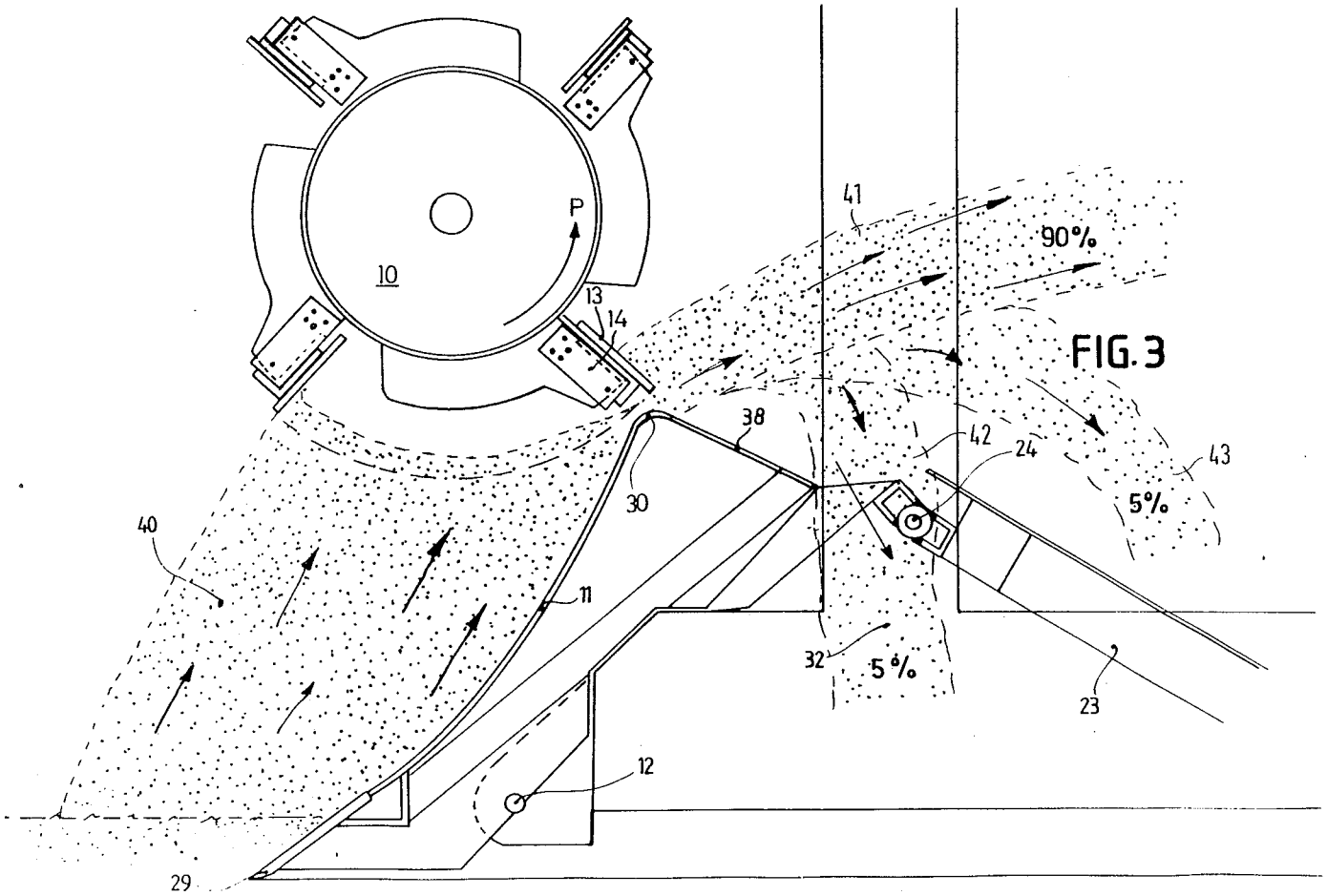
FIG. 3 shows the part of FIG. 2 in a second position, wherein the scraped off soil is thrown away.

The position of scraper blade 11 and the pivotally interconnected front bottom wall or bottom flap 23 is determined by at least one hydraulic cylinder 26 (FIG. 1, FIG. 3).

The rear bowl portion 7 is closed by a closure flap 27, which can be maintained in opened and closed position in response to the operation of at least one hydraulic cylinder 28.

The operation of the earth mover attached via coupling means to a tractor and besides via cardan shaft 15 to the power take-off shaft of the tractor and finally, in a manner not further shown, to the hydraulic system of the tractor, can be described as follows.

In retracted position of hydraulic cylinder 26 and hydraulic cylinder 21, the apparatus is in the position shown in FIG. 1, in which bottom flap 23 is closed and scraper blade 11 with the scraper edge 29 extends into the soil. The inclination of the scraper blade relative to the ground is then suitable for pushing up soil, as shown in FIG. 1. When pulling the earth mover forwards by means of the tractor in the direction shown by arrow S, the scraper edge 29 of scraper blade 11 scrapes off a layer of soil (FIG. 2) which ascends against the scraper blade. The layer thickness of the soil that is taken up depends upon the depth adjustment of the scraper blade 11 effected with the hydraulic cylinder 21.

The soil 40 abutting on scraper blade 11 moves upwards towards the ever narrowing slotted space 31 between the scraper blade and the rotor 10 provided above and in front of the scraper blade, said soil being subjected to an ever increasing pressure force. Within the reach of the bars 13 co-rotating with rotor 10, the compacted soil is engaged by the bars and, while being compacted further, is urged further into the slotted space 31 as far as the rib 30 of the scraper blade and beyond. The soil contained in the slotted space 31 can attain a speed of about 60 km/h. in the region between rotor 10 and rib 30 of scraper blade 11. In the space after rib 30, the soil suddenly expands and is thrown for the major part (about 90%) in an oriented jet 41 in the direction of the rear bowl portion 7 and is received therein, with the bowl portion 35 being gradually filled from the rear to the front. About 5% of the soil leaving the slotted space between rotor 10 and rib 30 is oriented badly and drops practically immediately and escapes again outwardly via leakage slot 32 (FIGS. 2 and 3), as shown at 42. The remaining soil 43 falls into the front bowl portion 6.

Such an oriented jet, as indicated e.g. at 41, is necessary for effectively filling a bowl of some extent. However, an oriented jet can only be obtained if the soil does not or only slightly stick to the bars and to the scraper blade. It has been experimentally found that such an adhesive effect is absent in an apparatus according to the present invention, not even if soil is processed that is rather strongly adhesive in itself.

It is assumed that this results from the space tapering, upon rotation of the rotor from the position shown in FIG. 2 to the position shown in FIG. 3, which space is available for an amount of soil entrained by a bar 13. The soil is urged by the bar against the upper portion of the scraper blade and thereby slides slightly over the surface of the bar, so that the sticking effect is prevented. A bar-entrained packet of soil can thus be thrown in an oriented jet into the bowl.

The layer lying against the scraper blade is slowed down against the scraper blade due to friction and falls into the front of the bowl, as shown at 43. A tiny portion of the soil passes the rib 30 of the scraper blade at very low speed. This soil can escape directly behind the rib 30 of the scraper blade through a leakage slot 32, thereby preventing an undesirable accumulation of soil directly behind the scraper blade. Such an accumulation would exclude or at least impede partly an oriented jet 41.

Figure 4:
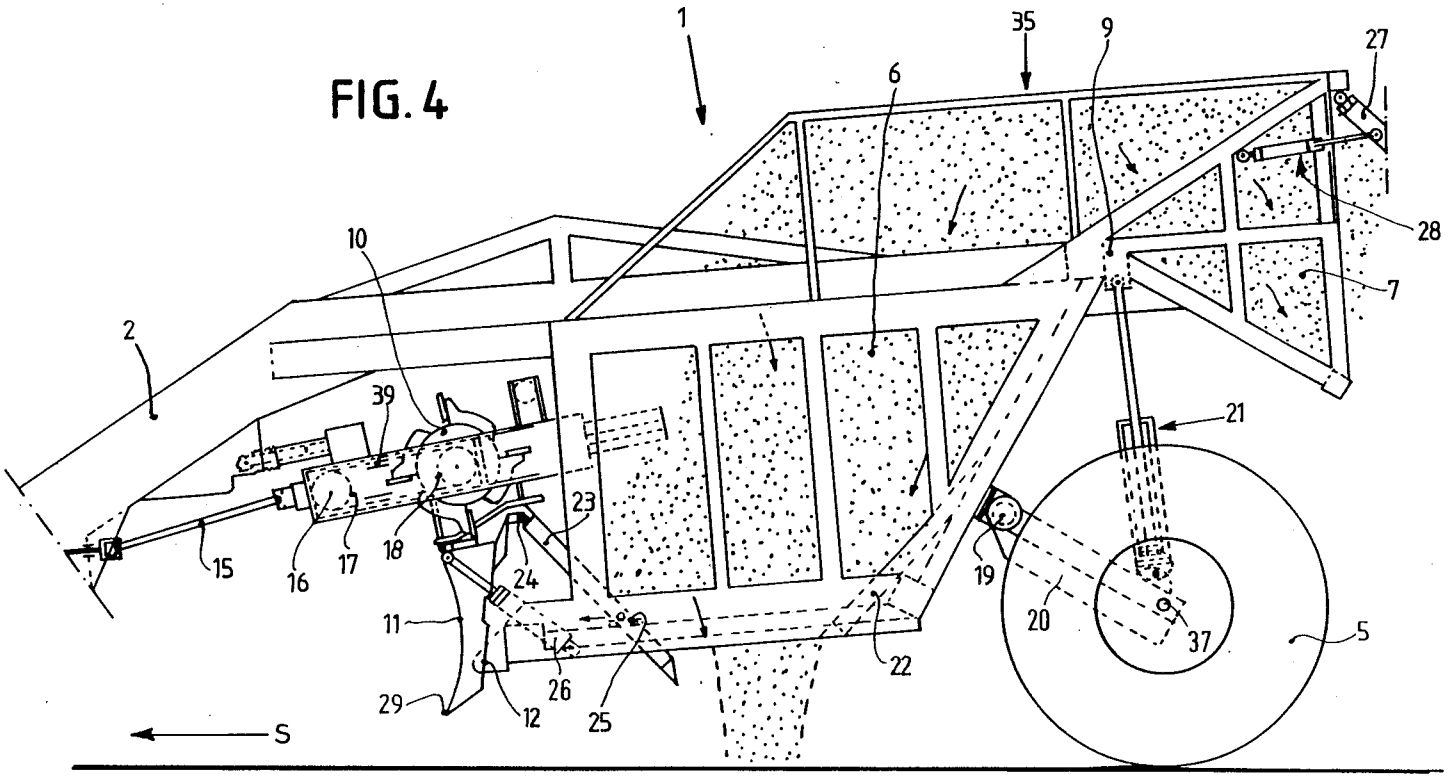
FIG. 4 is a side view of the earth mover shown in FIG. 1 in a position serving for unloading the collected soil.

When the bowl 35 is filled, the earth mover can be brought into the transport position by energizing the hydraulic cylinder 21, with the entire frame and the interconnected scraper blade 11 being lifted. After the earth mover with the tractor has been driven to a selected terrain, the soil is unloaded, from the rear bowl portion 7 by opening the closure flap 27 with one or more hydraulic cylinders 28 and from the front bowl portion 6 by sliding away the bottom flap 23. To that end, the piston rod of the hydraulic cylinder(s) 26 is driven outward, while the scraper blade 11 pivots about blade pivot point 12 with its upper portion forward and to a more perpendicular position, thereby entraining the bottom flap 23 connected to the upper portion of the scraper blade. The resulting position of the apparatus is shown in FIG. 4. In this position of the scraper blade 11, if desired, after further adjustment of the distance to the ground by means of hydraulic cylinders 26 and 21, the deposited earth can be levelled to a uniform layer by means of scraper blade 11, which is then usable as levelling instrument.

The presence of a leakage slot at relatively short distance behind the assembly of rotor 10 and scraper blade 11 is highly important for a proper operation of the assembly. In the absence of a leakage slot, the 5% badly oriented amount of soil closely behind the scraper blade would result in the formation of a pile of soil disturbing the proper operation of the apparatus. The discharge of the soil falling down just behind the assembly through the leakage slot 32 in outward direction is promoted by converting the scraper blade beyond rib 30 into a sliding plate 38 oriented obliquely downwards. Plate 38 could also form a downwardly curved surface, as shown in FIG. 2 with a broken line 38'.

The pivotal attachment of bottom flap 23 to the upper edge of the scraper blade, as shown in the drawing (FIG. 4), together with the sliding connection 25 of the bottom flap to the frame, ensures that when the bottom of the bowl is opened by energization of the hydraulic cylinder 26, the bottom flap 23 is tilted, in the drawing to the right and upwards. As a result, it is ensured that bowl 35, and its front compartment 6, respectively, is entirely emptied.

It is observed that it is not strictly necessary to interconnect the scraper blade and the bottom flap. Both members may be attached to the frame independently of one another and be provided with separate operating cylinders. The bottom flap could be placed alternatively opposite the scraper blade, instead of directly beyond the scraper blade.

In the embodiment shown, bowl 35 is divided into two separate compartments 6,7, having separate unloading flaps 25 and 27, respectively. The one compartment 6 lies in front of axle 37 and the other compartment 7 lies behind the wheel axle. With a drawn apparatus having a single axle, there is thus obtained a favourable load on the tractor coupling. In principle, however, the present invention can be applied just as well when the bowl has only a single compartment.

The working width of the apparatus can be increased by using an additional scraper blade portion at one or both ends of the scraper blade 11. Such scraper blade portions, shown in FIG. 5 at 36, are oriented preferably slightly obliquely forward, as shown in FIG. 5*b*.

In actual practice, it frequently occurs that the bowl of an earth mover of the type to which the present invention relates, as viewed transwisely, is loaded inequally. For this or other reasons, there may be a need for a possibility to incline the apparatus to the left or to the right. To that end, according to the present invention, there is provided a rocking device, which is further shown in FIG. 6.

FIG. 6 shows diagrammatically the wheel axle 37 of an apparatus according to the present invention. Axle 37 has a central portion 50 whereon a support 51 is mounted. Furthermore, a counter-support 52 connected to the arm 20 is mounted about the central portion 50.

Counter-support 52 and support 51, in this example, have opposite support portions 53,54 projecting above the central portion 50 of axle 37, between which support portions there is mounted a double-acting hydraulic cylinder 55. On energization of cylinder 55, the support portions 53,54 are moved towards or away from one another, resulting in an inclination of the bowl and the scraper blade in the one or the other direction.

Naturally, modifications may be applied to the earth mover as discussed above and as shown in the drawings, without departing from the scope of the present invention. For instance, an earth mover according to the present invention may be provided with its own drive means. In that case, at least one wheel pair is present. Also, an apparatus according to the present invention without its own drive means may have a multi-axle design.

Besides, if desired, there may be mounted underneath the rotor a guard plate extending obliquely downwards towards the scraper blade.

The bars, in the example shown, are mounted fixedly but may also be spring-mounted, so that the bars can swing away in the case of too high a load, e.g. because stones or pieces of wood are present between the rotor and the scraper blade. Possibly, also shearing pins or the like may be used. These and similar modifications are deemed to fall within the scope of the present invention.

I claim:

1. An earth mover comprising (A) at least one wheeled axle;

(B) a supported frame movable by said axle, said frame further including means for pushing up earth, comprising an elongate scraper blade with a ground-facing sharp longitudinal edge being substantially right-angled to the forward direction of travel of said frame, characterized by (C) a cylindrical rotor spaced from, and in operative position above, said scraper blade and substantially parallel thereto;

(D) means for rotating said rotor in a direction from said longitudinal edge towards the upper portion of said scraper blade;

(E) bars fixedly mounted on said rotor, with the distance from the turning circle circumference of said bars to said scraper blade decreasing in the rotation direction of said rotor; and (F) a frame-mounted bowl for earth transport having at least one compartment located behind said scraper blade, with at least one bottom portion extending obliquely downwards as a flap for unloading earth; said bottom flap being connected pivotally to said scraper blade near said one longitudinal edge and adapted to coact therewith for releasing and closing said compartment bottom portion, said bottom flap being connected furthermore to said frame by means of a sliding connection.

2. An apparatus as claimed in claim 1, characterized in that said bottom flap forms part of the front bottom wall of said bowl.

3. An apparatus as claimed in claim 1, wherein the angle of inclination of said scraper blade relative to the ground is variable, characterized in that the apparatus is provided with scraper blade-engaging means which vary the angle of inclination of said scraper blade, with simultaneous release or closure of said compartment bottom by said bottom flap.

4. An earth-mover comprising (A) at least one wheeled axle;

(B) a supported frame movable by said axle, said frame further including means for pushing up earth, comprising an elongate scraper blade with a ground-facing sharp longitudinal edge being substantially right-angled to the forward direction of travel of said frame, characterized by (C) a cylindrical rotor spaced from, and in operative position above, said scraper blade and substantially parallel thereto;

(D) means for rotating said rotor in a direction from said longitudinal edge towards the upper portion of said scraper blade;

(E) flat bars fixedly mounted on said rotor, with the distance from the turning circle circumference of said bars to said scraper blade decreasing in the rotation direction of said rotor and reaching a minimum closely adjacent the highest part of said scraper blade;

(F) a frame-mounted bowl for earth transport; and (G) a leakage slot between said bowl and said scraper blade for leakage of earth during loading of said bowl with earth.

5. An earth mover comprising (A) at least one wheeled axle;

(B) a supported frame movable by said axle, said frame further including means for pushing up earth, comprising an elongate scraper blade with a ground-facing sharp longitudinal edge being substantially right-angled to the forward direction of travel of said frame, characterized by (C) a cylindrical rotor spaced from, and in operative position above, said scraper blade and substantially parallel thereto;

(D) means for rotating said rotor in a direction from said longitudinal edge towards the upper portion of said scraper blade;

(E) bars fixedly mounted on said rotor, with the distance from the turning circle circumference of said bars to said scraper blade decreasing in the rotation direction of said rotor;

(F) a frame-mounted bowl for earth transport having at least one compartment located behind said scraper blade, with at least one bottom portion extending obliquely downwards as a flap for unloading earth; said bowl being divided by a threshold into two communicating compartments, a front compartment and a rear compartment, with at least the bottom portion of said front compartment tapering downwards in a cross section parallel to the forward direction of travel, said bottom flap forming part of said bottom wall of said front compartment, while said rear compartment has a rear chute opening, a pivotable closure flap adapted to close said rear chute opening, and a bottom sloping downwards towards said rear chute opening.

6. An apparatus as claimed in claim 5, characterized in that the lowest edge of said downwardly sloping bottom of said rear compartment is likewise an edge of said rear chute opening.

7. An earth mover comprising (A) at least one wheeled axle;

(B) a supported frame movable by said axle, said frame further including means for pushing up earth, comprising an elongate scraper blade with a ground-facing sharp longitudinal edge being substantially right-angled to the forward direction of travel of said frame, characterized by (C) a cylindrical rotor spaced from, and in operative position above, said scraper blade and substantially parallel thereto;

(D) means for rotating said rotor in a direction from said longitudinal edge towards the upper portion of said scraper blade;

(E) flat bars fixedly mounted on said rotor, with the distance from the turning circle circumference of said bars to said scraper blade decreasing in the rotation direction of said rotor and reaching a minimum closely adjacent the highest part of said scraper blade;

(F) a frame-mounted bowl for earth transport having at least one compartment located behind said scraper blade, with at least one bottom portion extending obliquely downwards and being pivotable further obliquely downwards to serve as a bottom flap for unloading earth, said bowl being connected pivotally to said wheel axle through an arm;

(G) at least one hydraulic cylinder means connected between said wheeled axle and said bowl for tilting said bowl to an unloading position; said scraper blade being connected pivotally to said frame in blade pivot point relationship; and (H) at least one hydraulic cylinder means connected between said frame and said scraper blade for tilting said bottom flap to release said compartment bottom portion for unloading earth;

both of said hydraulic cylinder means coacting to dispose said bowl for unloading earth therefrom.

8. An earth mover comprising (A) at least one wheeled axle;

(B) a supported frame movable by said axle, said frame further including means for pushing up earth, comprising an elongate scraper blade with a ground-facing sharp longitudinal edge being substantially right-angled to the forward direction of travel of said frame, characterized by (C) a cylindrical rotor spaced from, and in operative position above, said scraper blade and substantially parallel thereto;

(D) means for rotating said rotor in a direction from said longitudinal edge towards the upper portion of said scraper blade;

(E) flat bars fixedly mounted on said rotor, with the distance from the turning circle circumference of said bars to said scraper blade decreasing in the rotation direction of said rotor and reaching a minimum closely adjacent the highest part of said scraper blade; and (F) an additional scraper blade portion directly mounted on at least one end of said scraper blade for movement therewith and for increasing the working width thereof;

said scraper blade being movable between earth pushing up and earth levelling orientations by varying the angle of inclination thereof relative to the ground, said additional scraper blade portion being disposed at a forward angle to said scraper blade, and the bottom edge of said additional scraper blade being above the bottom edge of said scraper blade when said scraper blade is in the earth pushing up orientation and level therewith in the earth leveling orientation; whereby said apparatus is useful both for pushing up and leveling earth.

9. An apparatus as claimed in claim 4, characterized in that said scraper blade is provided with a sliding plate sloping downwards from the highest point thereof towards said leakage slot.

10. An earth mover comprising (A) at least one wheeled axle;

(B) a supported frame movable by said axle, said frame further including means for pushing up earth, comprising an elongate scraper blade with a ground-facing sharp longitudinal edge being substantially right-angled to the forward direction of travel of said frame, characterized by (C) a cylindrical rotor spaced from, and in operative position above, said scraper blade and substantially parallel thereto;

(D) means for rotating said rotor in a direction from said longitudinal edge towards the upper portion of said scraper blade;

(E) flat bars fixedly mounted on said rotor, with the distance from the turning circle circumference of said bars to said scraper blade decreasing in the rotation direction of said rotor and reaching a minimum closely adjacent the highest part of said scraper blade; and (F) hydraulic rocking means adapted to incline said frame laterally relative to said at least one axle, said rocking means comprising a fixed support, a movable counter-support connected fixedly to said frame, and at least one hydraulic cylinder operative between said fixed support and said movable counter-support, both of said supports being mounted on said wheeled axle.

* * * * *